United States Patent [19]

Crane

[11] Patent Number: 4,544,039

[45] Date of Patent: Oct. 1, 1985

[54] TORQUE TRANSDUCING SYSTEMS FOR IMPACT TOOLS AND IMPACT TOOLS INCORPORATING SUCH SYSTEMS

[75] Inventor: David O. Crane, Leicestershire, United Kingdom

[73] Assignee: Crane Electronics, Limited, Nuneaton, United Kingdom

[21] Appl. No.: 481,579

[22] Filed: Apr. 1, 1983

[51] Int. Cl.[4] ..... B25B 23/145

[52] U.S. Cl. ..... 173/12; 173/2; 81/467; 73/862.35; 73/862.33; 73/862.21

[58] Field of Search ..... 173/12, 2, 163; 73/862.21, 862.33, 862.34, 862.35; 33/1 PT; 81/467, 469, 479

[56] References Cited

U.S. PATENT DOCUMENTS

| | | | |
|---|---|---|---|
| 2,392,293 | 1/1946 | Ruge | 73/862.35 |
| 2,428,012 | 9/1947 | Collins et al. | 73/862.35 X |
| 2,873,584 | 2/1959 | Clandy | 73/862.35 X |
| 3,555,894 | 1/1971 | Bratkowski | 73/862.35 X |
| 4,281,538 | 8/1981 | Dudek | 173/12 X |

*Primary Examiner*—E. R. Kazenske
*Assistant Examiner*—Willmon Fridie, Jr.
*Attorney, Agent, or Firm*—Cohn, Powell & Hind

[57] ABSTRACT

A torque transducing system for an impact tool such as an impact wrench incorporates a housing, bearings in the housing, a rotatable shaft journalled in the bearings, the shaft having a torque receiving input end and an output end supplying torque for a workpiece, a torque transducing gauge on the shaft intermediate the input and the output end for providing a first signal responsive to torque, circuitry on the rotatable shaft for modulating the first signal to a second signal, structure on the shaft for supplying current to the gauge and modulating circuitry and additional structure for transmitting the second signal, further structure on the housing for receiving the transmitted second signal, and circuitry for converting the second received signal to provide an output indicative of torque. Current can be supplied to and a signal can be obtained from the signal modulating circuitry by providing a plurality of brush assemblies mounted on the housing and the rotatable shaft has corresponding sliprings, one pair of said sliprings forming the aforesaid structure for supplying current to the torque transducing gauge and one slipring forming the additional structure for transmitting the second signal, the modulating circuitry including an amplifier to permit transmission of the second signal to its brush assembly with a proportionately low signal loss.

22 Claims, 9 Drawing Figures

TORQUE TRANSDUCING SYSTEMS FOR IMPACT TOOLS AND IMPACT TOOLS INCORPORATING SUCH SYSTEMS

FIELD OF INVENTION

The invention relates to torque transducing systems for impact tools sometimes referred to as impact wrenches and to tools having such systems.

BACKGROUND OF INVENTION

In impact tools a mass is made to rotate, generally by using a compressed air driven motor, and the momentum of the rotating mass is transferred to an output member to fasten a bolt or nut. A major benefit of such tools is their ability to revolve the output member rapidly under no load and to achieve high torque when turning the bolt or nut home to complete a joint without the operator experiencing appreciable reaction forces. The momentum of the mass is transferred by a dog-clutch type of mechanism which transfers the momentum over typically a 5° turn of the output member before disengaging to enable the mass to once more build up rotating momentum.

Hitherto torque has been controlled generally by calibrating the impact tool to ensure that it generates the necessary torque after applying it for a given time. On the tool itself the impact action is brief and violent and the spinning speeds are high so discouraging attempts to measure torque. Although impact tools can be calibrated to give certain levels of impact, the calibrated level of impact may be difficult to maintain due to compressed air pressure fluctuations. The tightness of a joint can also be influenced by the varying nature of joints some of which may require a prolonged period of impact operation before their completion (so-called soft joints).

It is the object of the invention to provide a system for torque transducing on impact tools which is reliable and can be used on the impact tool to enable a predetermined torque output and predetermined joint strengths to be obtained.

SUMMARY OF INVENTION

In the invention a torque transducing system is built of rugged relatively simple components by modulating the torque related signal on a rotating member transmitting torque from an impact tool to a workpiece driven by the rotating member. Thus a relatively simple slipring-brush system may be used for signal transmission without having to seal the slipring brush system or the use of costly special contact materials. The brush assembly can be adapted to permit the brush to remain in contact with the slipring even with the vibration and high speed operation occurring in the use of impact tools. Preferably each brush assembly includes a pair of brush arms pivotably mounted at one end with respect to the housing, resilient means biassing the arms towards each other, resilient, electrically conductive strips extending toward and alongside the slipring, and brushes secured to the strips to engage the slipring at substantially diametrically opposite positions, signal loss being reduced by maintaining the brushes in contact with the slipring by resilient movement of the arms as a whole with respect to the housing and by that of the brushes with respect to the brush arms by resilient deformation of the strips. Strong vibration proof mounting of the sliprings is achieved by an arrangement wherein the sliprings are mounted on an assembly including a metal bush secured at one end to rotatable member and surrounding part of the rotatable member intermediate the input and output end carrying the torque transducer, insulating slipring spacing means for spacing the sliprings from said bush radially and axially with respect to each other and an internally threaded member for threadingly engaging the other end of the bush to thereby lock the sliprings and spacing means together by clamping them. Special mounting of electrical components is necessary to permit them to survive vibration and acceleration forces.

The invention also provides a useful signal by modulating the output as will be explained.

The system can indicate relatively accurately the strengths of a joint even where there are different joint characteristics.

The transducing system may be produced as a retrofit for existing lines of impact tools, or they may be designed as an integral part of an impact tool. Display of the torque output levels may be on the tool itself or on a remote unit, advantageously microprocessor controlled.

DRAWINGS

Figure 1:
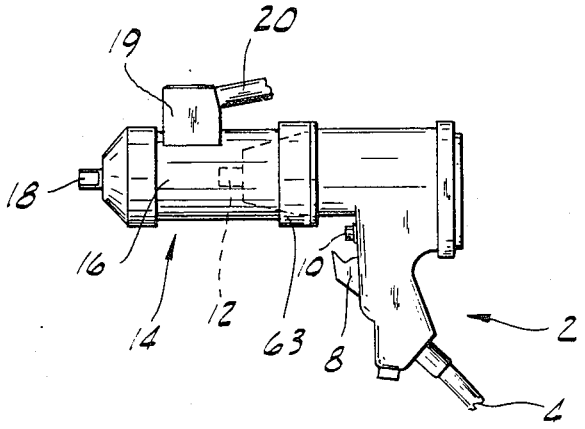
FIG. 1 is a side view of an impact tool having an impact torque transducing system according to the invention.
Figure 4:
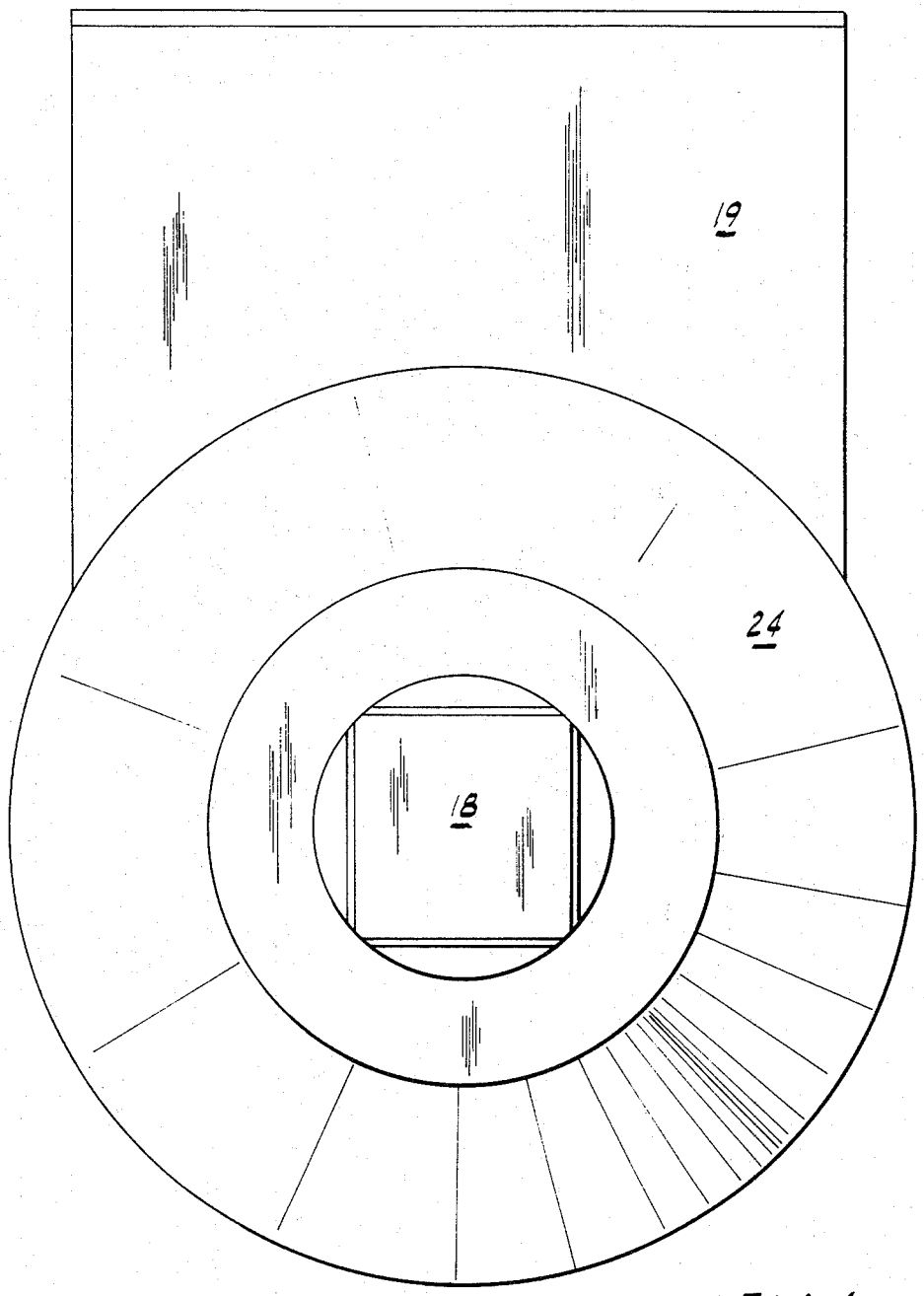
FIG. 4 is a front end view of the system of FIG. 2.

With reference to FIGS. 1 and 4, an impact tool 2 in the form of a wrench for fastening wheel nuts or bolts has a compressed air supply hose 4 with a trigger 8 and a knob 10 for reversing the direction of tool rotation. The impact tool 2 is of any conventional source and contains an air motor and a rotatable member to which the air motor can be clutched to build up rotating momentum or torque preparatory for impact. Member 12 is part of the impacted body and provides a mechanical input into a transducer 14 fastened to the tool 2 by a clamping ring 63 and having a housing 16 from which a torque output part 18 protrudes. The housing 16 mounts a brush assembly 19 electrically connected to a master control box (not shown) through cable 20.

Figure 2:
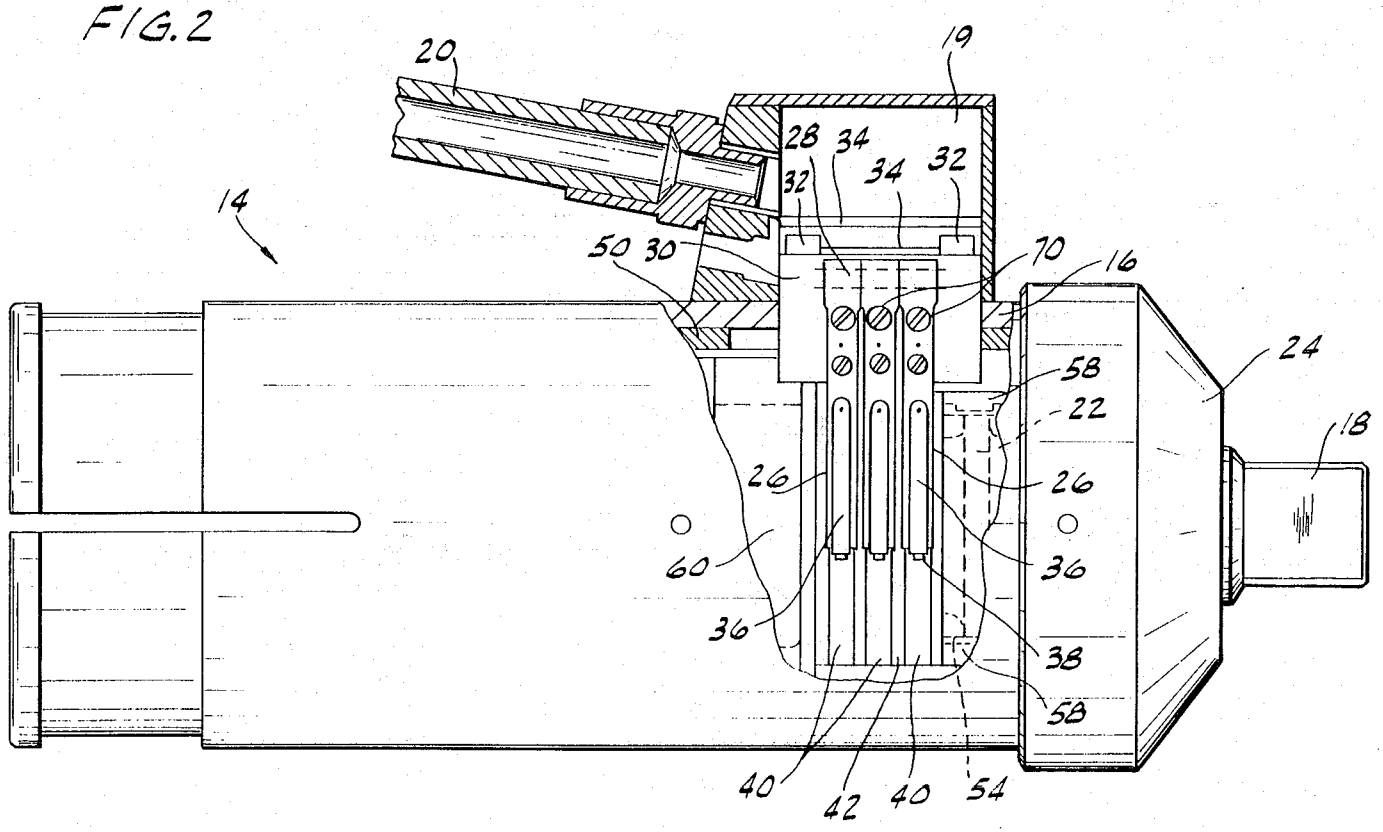
FIG. 2 is a side view, partly broken away, of the torque transducing system of the tools of FIG. 1.

With reference to FIG. 2, the housing 16 supports a rotating member or shaft 22, of considerable rigidity, the output part 18 thereof being integral and passing through an end cap 24. The housing 19 contains brush arms 26 for movement about pivots 28 on a brush arm mounting 30 secured by screws 32 to the housing 16. Printed circuit boards 34 are mounted to the outward end of the mounting 30. Screws 38 secure resilient strips 40 to the ends of the arms 26. Sliprings 40 and spacers 42 surround the shaft 22 and are mounted on a bush 54. Resin 60 fills an annular space 61 containing a rotatable part of an electric circuit.

Figure 3:
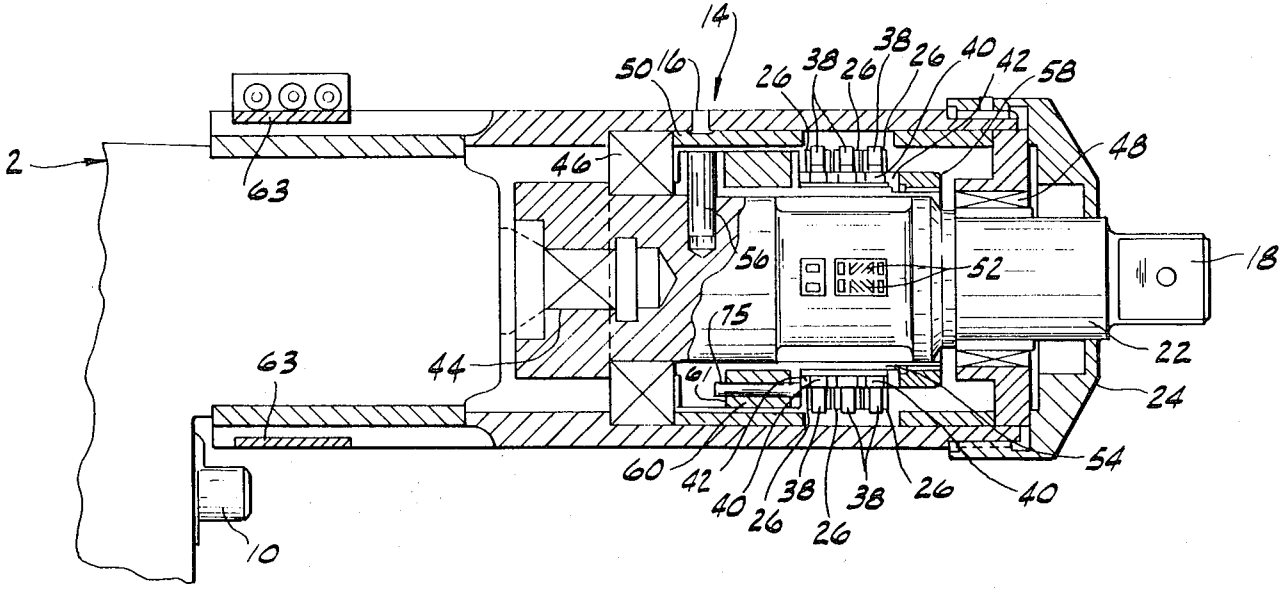
FIG. 3 is a longitudinal section of the system of FIG. 2.

With reference to FIG. 3, it can be seen that the shaft 22 has an input end 44 for receiving the output part 18 of the tool 2. The shaft 22 is supported by a ball bearing 46 and needle bearing 48 in the housing 16, the bearings being spaced by a sleeve 50. The shaft 22 has a reduced thickness portion carrying four foil strain gauges 52 made for example by Micro measurement Inc. Raleigh, N.C. of conventional design, one pair on each side of the shaft 22. Each one of the gauges of the adjacent pairs is sensitive to distortion of the shaft resulting from torque applied across the shaft ends. The electrical resistance of the gauges 52 varies with torque. For each pair, the gauges 52 are oppositely biassed to permit detection of torque in both directions of rotation of the shaft 22 about the axis. This will be explained in more detail by reference to the description of the associated circuit.

The gauges 52 are electrically connected to electrical components embedded in an annular space 61 filled with the resin 60 formed in a bush 54 secured at one end with adhesive and three pins 56 to the shaft 22. The remainder of the bush 54 envelops the intermediate shaft part with the gauges 52. The top end of the bush 54 is free to move with respect to shaft 22 so that the bush is not subjected to the torque applied across the shaft 22.

Figure 5:
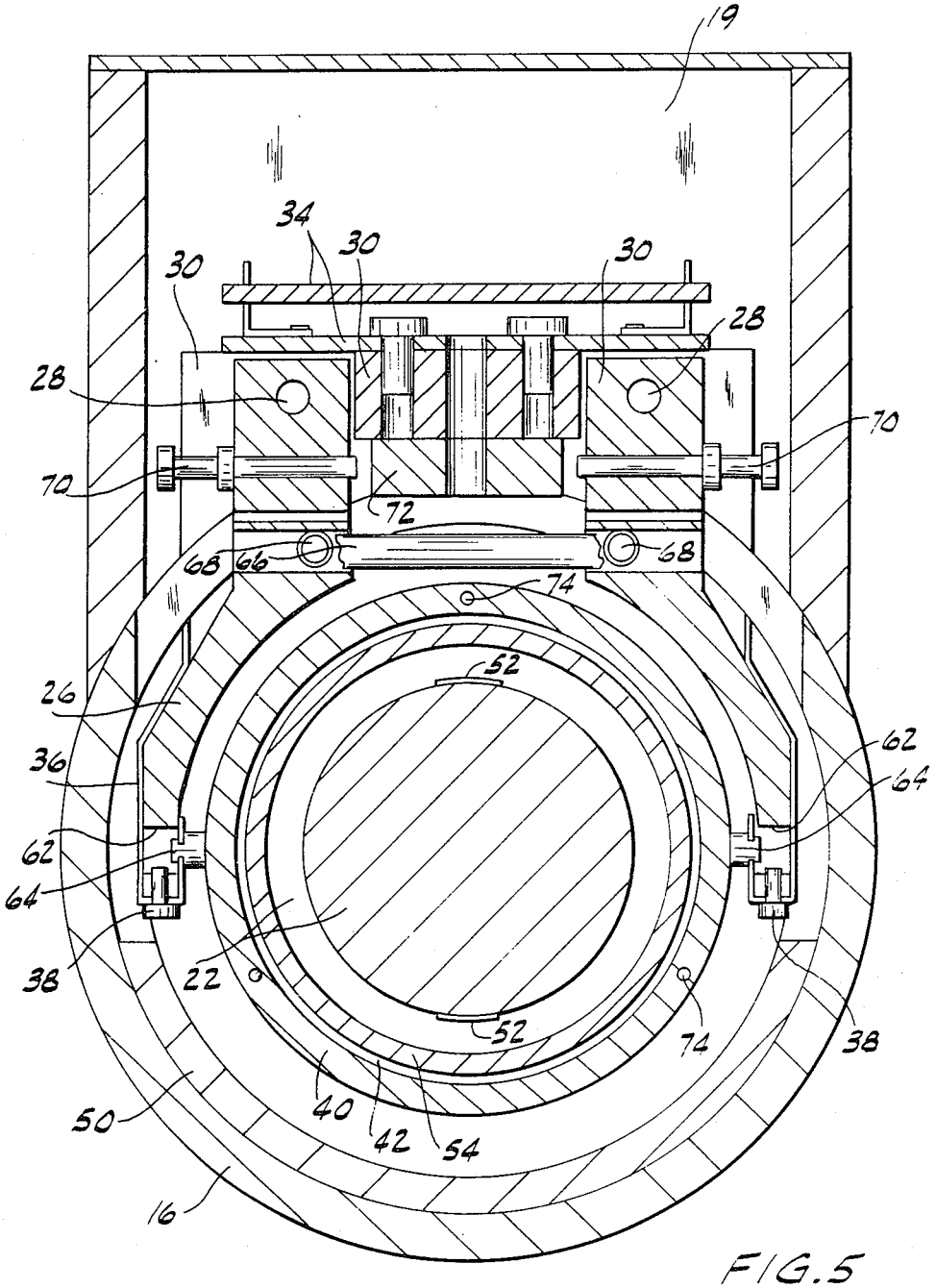
FIG. 5 is a cross-section of the system of FIG. 2 through a brush assembly.

With reference to FIGS. 2, 3 and 5, each of the brush arms 26 of the three brush assemblies has a brush 64 at its end. The brushes are mounted on the inwardly inclined ends of the strips 40. The brushes 64 are located next to holes 64 to permit their resilient movement toward and away from the arms 26 and for passing the necessary electrical wiring (not shown). The arms 26 are sprung together by springs 66 anchored at 68 and their travel towards one another is limited by studs 70 which abut a block 72 when the brush is nearly worn, thus permitting a warning signal to issue before brushes become useless. The various sliprings 40 and spacers 42 are also bonded together but the nut 58 permits them to be pressed firmly together to firmly secure their position. Three holes 74 pass through the sliprings 40 and spacers 42 to pass wiring for electrically connecting the sliprings 40 to electrical components in the annular space 61.

The resin 60 is restrained against detachment by vibration by six evenly spaced rods 75 passing through the resin 60 and located in holes in the bush 54.

The brush assembly maintains proper brush-slipring contact in use of the impact tool 2.

Figure 6:
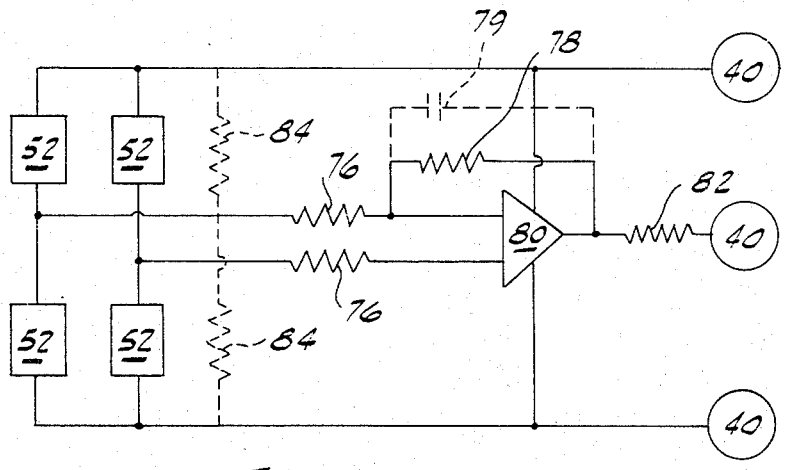
FIG. 6 is a circuit diagram of the rotatable electronics.

With reference to FIG. 6, the four gauges 52 are connected to provide a Wheatstone bridge circuit to provide first signals to an amplifier 80 through resistors 76 all contained in the resin 60. There is a feedback resistor 78 across the amplifier 80 establishing its gain by the ratio of resistance between resistor 76 and resistor 78. A capacitor 79 may be positioned across the amplifier 80. A second output in the form of an amplified signal, passes, through resistor 82, to one of the three sliprings 40, the other two being used to supply direct current to the rotating system. Optionally resistors 84 may be added for balancing the Wheatstone bridge circuit.

Figure 7:
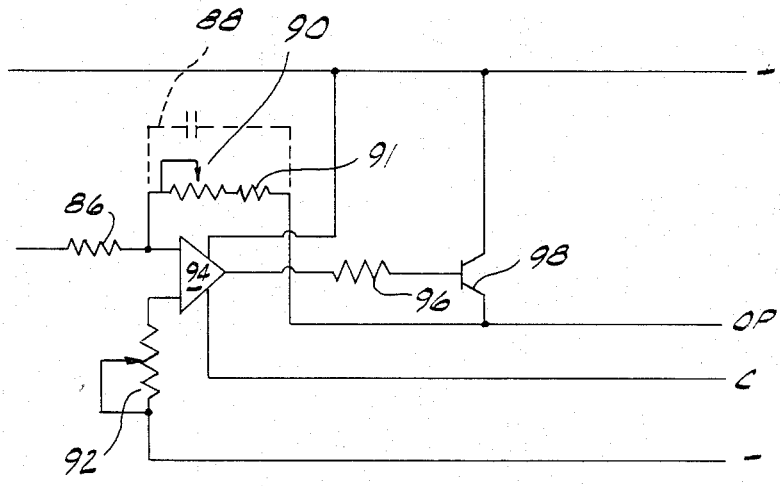
FIG. 7 is a schematic circuit diagram of the stationery electronics.

With reference to FIG. 7, the PCB's 34 carry a resistor supplying the second signal from amplifier 80 to a further amplifier 94 over resistor 86. A capacitor 88 may be in parallel to the amplifier 94 as is a potentiometer 90 which determines the measuring span. Feedback resistor 91 helps to set the amplifier gain. A further potentiometer 92 can be used to set a zero level for calibration purposes. The amplifier output is supplied through resistor 96 for a transistor 98 operating in emitter-follower mode to provide a final output signal. In any case one of the capacitors 79 or 88 is provided. The capacitor(s) provide a frequency response characteristic and act as a capacitive feedback network. Other active feedback/filter networks of equivalent effect may be used. The nature of the frequency response has to be selected by trial and error for a given application. The end product should be a signal of a magnitude and polarity corresponding to the magnitude and direction respectively of the torque retained by a joint, as typically, measured by dial-indicating torque wrenches in the "just-moved" test carried out by most quality-control staff in assembly. Surprisingly once a suitable frequency response characteristic is established, the output signal will correspond to the torque retained over a wide range of joint types and succcessive stages of joint completion. The frequency response characteristic may also be reproduced by digitial techniques.

The final signal may be supplied to a microprocessor for analysis, recording etc. Because of the signal accuracy and the continuous monitoring of torque, the air supply can be switched off automatically once the desired joint completion stage has been reached.

Figure 8:
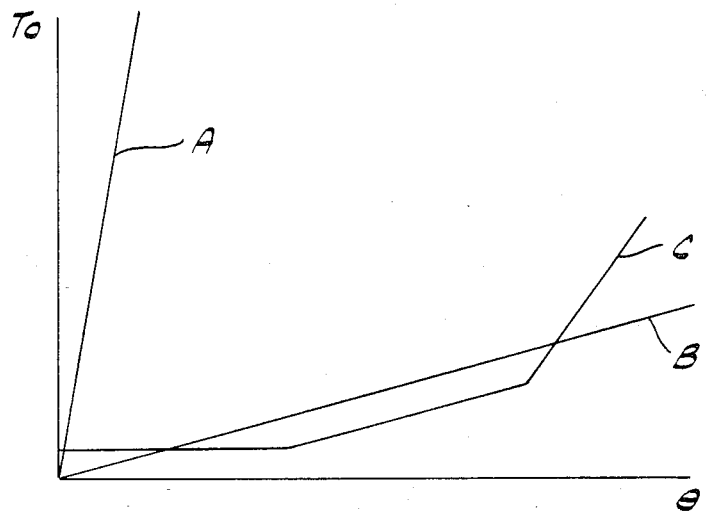
FIG. 8 is a graph illustrating torque variations in use of impact tools.

With reference to FIG. 8, To is plotted against angular movement $\theta$ of the shaft 22. Line A shows an idealized "hard" joint where the torque increases rapidly as a nut is tightened. Line B shows an idealized "soft" joint where the torque increases gradually as a nut is tightened, many more turns being necessary to secure the nut compared with A. Line C shows a real nut tightening sequence starting with a very low torque running of a nut along a bolt to a washer, a gradual increase in torque as resilient play in the joint is taking up and a final rapid increase in torque as the joint becomes "hard". Apart from the hardness of joints, friction and similar effects may also influence the speed at which a joint is completed.

Figure 9:
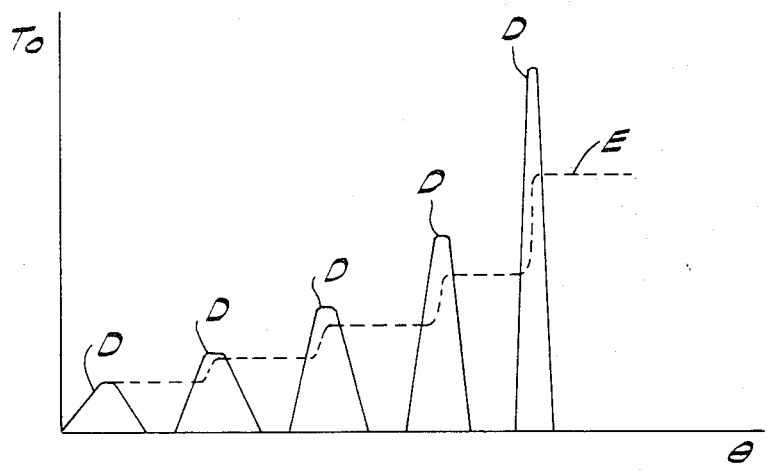
FIG. 9 is a graph indicative of output signal modulation used by the torque transducing system of the invention.

With reference to FIG. 9 a short time span is analysed in more detail showing individual successive impacts as a joint is tightened (line D). Initially the impact is translated into a low level of torque for a long period. As tightening progresses the impacts result in higher torque applied but a shorter resultant displacement of the shaft 22. The invention provides as an output a signal corresponding to line E by the inclusion in the circuitry of the frequency response characteristic.

Using the invention such a reliable signal can be obtained in an arrangement which resists the considerable vibrations and g-forces arising in impact tools.

In some embodiments of the invention, the torque transducing system can be used to provide an automatic power cut-off. In other embodiments, the tool may carry indicator lights to show when a desirable torque has been exceeded without the power being cut off but relying on the operator to switch off power. The circuitry connected to the indicator lights may then be set to operate the indicator lights at the desired torque level. The latter embodiment can conveniently be battery powered as no servo-controlled pneumatic valves need to be included.

I claim:

1. Torque transducing system including a housing, bearings in the housing, a rotatable shaft journalled in the bearings, said shaft having a torque receiving input end and an output end supplying torque for a workpiece, a torque transducing gauge on the shaft intermediate the input and the output end for providing a first signal responsive to torque, means on the rotatable shaft for modulating the first signal to a second signal, a plurality of brush assemblies mounted on the housing and a corresponding plurality of sliprings on the rotatable shaft, one pair of said sliprings forming a means for supplying current to the torque transducing gauge and one slipring forming a means for transmitting the second signal, the modulating means including an amplifier to permit transmission of the second output signal to its brush assembly with a proportionately low signal loss to provide an output indicative of torque in which each brush assembly includes a pair of brush arms pivotably mounted at one end with respect to the housing, resilient means biassing the arms towards each other, resilient, electrically conductive strips extending toward and alongside the slipring, and brushes secured to the strips to engage the slipring at substantially diametrically opposite positions, signal loss being reduced by maintaining the brushes in contact with the slipring by resilient movement of the arms as a whole with respect to the housing and by that of the brushes with respect to the brush arms by resilient deformation of the strips.

2. Torque transducing system as claimed in claim 1, in which the sliprings are mounted on an assembly including a metal bush secured at one end to the rotatable shaft and surrounding the rotatable shaft intermediate the input and output end for carrying the torque transducer, insulating slipring spacing means for spacing the sliprings from said bush radially and axially with respect to each other and an internally threaded member for threadingly engaging the other end of the bush to thereby lock the sliprings and spacing means together by clamping them.

3. Torque transducing system as claimed in claim 1 in which there is associated with the rotatable shaft an annular space mounting at least the modulating means, said space being filled with a resilient material and rods extend axially through said space and said resilient material for stable support thereof.

4. Torque transducing system as claimed in claim 1 wherein there is provided a frequency responsive network for conditioning the second output signal to make it indicative of torque retained by the workpiece.

5. Torque transducing system as claimed in claim 4 in which the frequency responsive network includes a capacitive feedback network associated with an amplifier stage.

6. Torque transducing system as claimed in claim 1 in which a means is provided for providing an output display from the output and for providing a switch off signal for an impact tool when a predetermined output is reached.

7. Impact tool including an air motor, and a member providing impact torque having a torque transducing system including a housing, bearings in the housing, a rotatable shaft journalled in the bearings, said shaft having a torque receiving input end and an output end supplying torque for a workpiece, a torque transducing gauge on the shaft intermediate the input and the output end for providing a first signal responsive to torque, means on the rotatable shaft for modulating the first signal to a second signal, a plurality of brush assemblies mounted on the housing and a corresponding plurality of sliprings on the rotatable shaft, one pair of said sliprings forming a means for supplying current to the torque transducing gauge and one slipring forming a means for transmitting the second signal, the modulating means including an amplifier to permit transmission of the second output signal to its brush assembly with a proportionately low signal loss to provide an output indicative of torque, each brush assembly including a pair of brush arms pivotably mounted at one end with respect to the housing, resilient means biasing the arms towards each other, resilient, electrically conductive strips extending toward and alongside the slipring, and brushes secured to the strips to engage the slipring at substantially diametrically opposite positions, signal loss being reduced by maintaining the brushes in contact with the slipring by resilient movement of the arms as a whole with respect to the housing and by that of the brushes with respect to the brush arms by resilient deformation of the strips.

8. Impact tool as claimed in claim 7 in which there is associated with the rotatable shaft an annular space mounting at least the modulating means, said space being filled with a resilient material and rods extend axially through said space and said resilient material for stable support thereof.

9. Impact tool as claimed in claim 7 in which there is provided a frequency responsive network for conditioning the output to make it indicative of torque retained by the workpiece.

10. Impact tool as claimed in claim 7 in which a means is provided for providing an output display from the output and for providing a switch off signal for the impact tool when its predetermined output is reached.

11. Impact tool as claimed in claim 7 further provided with a battery and means on the tool for displaying the torque output level to permit the operator to switch off the tool when a desired torque output level is reached.

12. Torque transducing system including a housing, bearings in the housing, a rotatable shaft journalled in the bearings, said shaft having a torque receiving input end and an output end supplying torque for a workpiece, a torque transducing gauge on a shaft intermediate the input and the output end for providing a first signal responsive to torque, means on the rotatable shaft for modulating the first signal to a second signal, a plurality of brush assemblies mounted on the housing and a corresponding plurality of sliprings on the rotatable shaft, one pair of said sliprings forming a means for supplying current to the torque transducing gauge and one slipring forming a means for transmitting the second signal, the modulating means including an amplifier to permit transmission of the second signal to its brush assembly with a proportionately low signal loss to provide an output indicative of torque, the sliprings being mounted on an assembly including a metal bush secured at one end to the rotatable shaft and surrounding the rotatable shaft intermediate the input and output end for carrying the torque transducer, insulating slipring spacing means for spacing the sliprings from said bush radially and axially with respect to each other and an internally threaded member for threadingly engaging the other end of the bush to thereby lock the sliprings and spacing means together by clamping them.

13. Torque transducing system as claimed in claim 12 in which each brush assembly includes a pair of brush arms pivotably mounted at one end with respect to the housing, resilient means biassing the arms towards each other, resilient, electrically conductive strips extending toward and alongside the slipring, and brushes secured to the strips to engage the slipring at substantially diametrically opposite positions, signal loss being reduced by maintaining the brushes in contact with the slipring by resilient movement of the arms as a whole with respect to the housing and by that of the brushes with respect to the brush arms by resilient deformation of the strips.

14. Torque transducing system as claimed in claim 12 in which there is associated with the rotatable shaft an annular space mounting at least the modulating means, said space being filled with a resilient material and rods extend axially through said space and said resilient material for stable support thereof.

15. Torque transducing system as claimed in claim 12 wherein there is provided a frequency responsive network for conditioning the second output signal to make it indicative of torque retained by the workpiece.

16. Torque transducing system as claimed in claim 13 in which the frequency responsive network includes a capacitive feed back network associated with an amplifier stage.

17. Torque transducing system as claimed in claim 12 in which a means is provided for providing an output display from the output and for providing a switch off signal for an impact tool when a predetermined output is reached.

18. Impact tool including an air motor, and a member providing impact torque having a torque transducing system including a housing, bearings in the housing, a rotatable shaft journalled in the bearings, said shaft having a torque receiving input end and an output end supplying torque for a workpiece, a torque transducing gauge on the shaft intermediate the input and the output end for providing a first signal responsive to torque, means on the rotatable shaft for modulating the first signal to a second signal, a plurality of brush assemblies mounted on the housing and a corresponding plurality of sliprings on the rotatable shaft, one pair of said sliprings forming a means for supplying current to the torque transducing gauge and one slipring forming a means for transmitting the second signal, the modulating means including an amplifier to permit transmission of the second output signal to its brush assembly with a proportionately low signal loss to provide an output indicative of torque in which the sliprings are mounted on an assembly including a metal bush secured at one end to the rotatable shaft and surrounding the shaft intermediate the input and putput end for carrying the torque transducer insulating slipring, spacing means for spacing the sliprings from said bush radially and axially with respect to each other and an internally threaded member for threadingly engaging the other end of the bush to thereby lock the sliprings and spacing means together by clamping them.

19. Impact tool as claimed in claim 18 in which there is associated with the rotatable shaft an annular space mounting at least the modulating means, said space being filled with a resilient material and rods extend axially through said space and said resilient material for stable support thereof.

20. Impact tool as claimed in claim 18 in which there is provided a frequency responsive network for conditioning the output to make it indicative of torque retained by the workpiece.

21. Impact tool as claiming in claim 18 in which a means is provided for providing an output display from the output and for providing a switch off signal for the impact tool when its predetermined output is reached.

22. Impact tool as claimed in claim 18 further provided with a battery and means on the tool for displaying the torque output level to permit the operator to switch off the tool when a desired torque output level is reached.

* * * * *